US010478662B2

(12) United States Patent
Davis

(10) Patent No.: US 10,478,662 B2
(45) Date of Patent: Nov. 19, 2019

(54) STRETCHING APPARATUS

(71) Applicant: Joshua Loren Davis, Lawrence, KS (US)

(72) Inventor: Joshua Loren Davis, Lawrence, KS (US)

( * ) Notice: Subject to any disclaimer, the term of this patent is extended or adjusted under 35 U.S.C. 154(b) by 330 days.

(21) Appl. No.: 15/450,209

(22) Filed: Mar. 6, 2017

(65) Prior Publication Data

US 2017/0259112 A1 Sep. 14, 2017

Related U.S. Application Data

(60) Provisional application No. 62/305,451, filed on Mar. 8, 2016.

(51) Int. Cl.

| | |
|---|---|
| ***A63B 21/00*** | (2006.01) |
| ***A61H 1/02*** | (2006.01) |
| *A63B 23/00* | (2006.01) |

(52) U.S. Cl.

CPC ..... *A63B 21/4043* (2015.10); *A61H 1/0237* (2013.01); *A63B 21/4013* (2015.10); *A61H 2201/0119* (2013.01); *A61H 2201/0126* (2013.01); *A61H 2201/0192* (2013.01); *A61H 2201/1253* (2013.01); *A61H 2201/164* (2013.01); *A61H 2201/1635* (2013.01); *A61H 2201/1642* (2013.01); *A61H 2203/0437* (2013.01); *A61H 2203/0456* (2013.01); *A63B 2023/006* (2013.01)

(58) Field of Classification Search

None

See application file for complete search history.

(56) References Cited

U.S. PATENT DOCUMENTS

| | | | | | |
|---|---|---|---|---|---|
| 518,967 | A * | 5/1894 | Poole | A63B 21/015 | 482/116 |
| 835,985 | A * | 11/1906 | Sharp | A62B 1/10 | 182/237 |
| 4,114,874 | A * | 9/1978 | Mattila | A63B 21/015 | 188/82.77 |
| 4,268,012 | A * | 5/1981 | Ruehle | B60P 7/083 | 24/909 |
| 4,618,140 | A * | 10/1986 | Brown | A63B 22/0076 | 482/112 |
| 5,275,579 | A * | 1/1994 | Wilkinson | A47C 3/20 | 248/157 |

(Continued)

*Primary Examiner* — Stephen R Crow

(74) *Attorney, Agent, or Firm* — Armstrong Teasdale LLP

(57) ABSTRACT

A stretching apparatus for use during a stretching exercise includes a strap and a ratchet device. The strap is configured to attach to a limb of a user. The strap extends through the ratchet device and the ratchet device controls tension in the strap. The ratchet device is positionable between a ratcheting position and a release position. The ratcheting position prevents movement of the strap in a first direction and allows movement of the strap in a second direction. The release position allows movement of the strap in the first direction. The stretching apparatus also includes a remote trigger connected to the ratchet device to move the ratchet device between the ratcheting position and the release position. The stretching apparatus removably connects to support structures and is adjustable between different positions for different stretching exercises.

18 Claims, 8 Drawing Sheets

(56) References Cited

U.S. PATENT DOCUMENTS

| | | | | |
|---|---|---|---|---|
| 5,904,638 | A * | 5/1999 | Habing | A63B 22/0605 482/57 |
| 6,634,995 | B1 | 10/2003 | Reed | |
| 7,946,969 | B1 | 5/2011 | Friess et al. | |
| 8,641,586 | B2 | 2/2014 | Bremer et al. | |
| 8,734,306 | B2 * | 5/2014 | Dunn | A63B 21/0552 482/126 |
| 9,339,682 | B2 * | 5/2016 | Braier | A63B 21/0442 |
| 9,427,619 | B2 * | 8/2016 | Franks | A63B 21/0442 |
| 2002/0022555 | A1 | 2/2002 | Nesci | |
| 2003/0114278 | A1 | 6/2003 | Rigas | |
| 2005/0187077 | A1 | 8/2005 | Daniel | |
| 2006/0046911 | A1 | 3/2006 | Leight | |
| 2006/0201450 | A1 | 9/2006 | Jordan et al. | |
| 2010/0234774 | A1 | 9/2010 | Cheremsky | |
| 2012/0322635 | A1 | 12/2012 | Carter | |

* cited by examiner

STRETCHING APPARATUS

CROSS-REFERENCE TO RELATED APPLICATIONS

This application claims priority to U.S. Provisional Patent Application Ser. No. 62/305,451, filed on Mar. 8, 2016, the disclosure of which is hereby incorporated by reference in its entirety.

FIELD

The field of the disclosure relates generally to apparatus for use in stretching. More particularly, this disclosure relates to stretching apparatus that include a ratchet device.

BACKGROUND

Stretching exercises include straightening or extending a body part such as a limb and are believed to increase flexibility and range of motion. However, it may be difficult for an individual to get a full stretch without assistance. Accordingly, some stretching exercises require an additional person and/or a stretching apparatus. At least some known stretching apparatus, such as resistance bands and exercise balls, are passive and may not provide a full stretch. In addition, some stretching apparatus include bulky and complicated mechanisms. As such, the stretching apparatus may not be suitable for home use and may be prone to breakage. Moreover, the stretching apparatus may be difficult for the individual to use unassisted and could lead to injury.

Therefore, there is a need for an improved stretching apparatus that provides a better stretch and can be assembled and used by an individual.

BRIEF DESCRIPTION

In one aspect, a stretching apparatus for use during a stretching exercise includes a strap and a ratchet device. The strap is configured to attach to a limb of a user. The ratchet device controls tension in the strap. The strap extends through the ratchet device. The ratchet device is positionable between a ratcheting position and a release position. The ratcheting position prevents movement of the strap in a first direction and allows movement of the strap in a second direction. The release position allows movement of the strap in the first direction. The stretching apparatus also includes a remote trigger connected to the ratchet device to move the ratchet device between the ratcheting position and the release position. A flexible line connects the remote trigger to the ratchet device. The remote trigger is configured to be held by the user during the stretching exercise.

In another aspect, a stretching apparatus for use during a stretching exercise includes a strap, a ratchet device, and a mount. The strap is configured to attach to a limb of a user. The ratchet device controls tension in the strap. The strap extends through the ratchet device. The mount is arranged to connect to the ratchet device and support the ratchet device during the stretching exercise. The stretching apparatus also includes a track arranged to receive the mount and connect to a surface to support the ratchet device during the stretching exercise. The mount is slidable along the track to adjust the position of the ratchet device relative to the track such that the ratchet device is positionable in a first position and a second position.

In yet another aspect, a method of assembling a stretching apparatus for use during a stretching exercise includes connecting a ratchet device to a mount. A strap extends through the ratchet device such that the ratchet device controls tension in the strap. The strap includes a first end and a second end. The first end is configured to attach to a limb of a user. The second end is configured to be grasped by the user. The method also includes connecting a track to a wall and movably connecting the mount to the track. The mount is slidable along the track to adjust the position of the ratchet device relative to the track such that the ratchet device is positionable in a first position and a second position. The method further includes moving the mount to the first position and securing the mount in the first position.

BRIEF DESCRIPTION OF THE DRAWINGS

Corresponding reference characters indicate corresponding parts throughout the several views of the drawings.

DETAILED DESCRIPTION

As used herein, the terms "stretch," "stretching," and "stretching exercise" refer to straightening or extending a portion of an individual's body.

Figure 1:
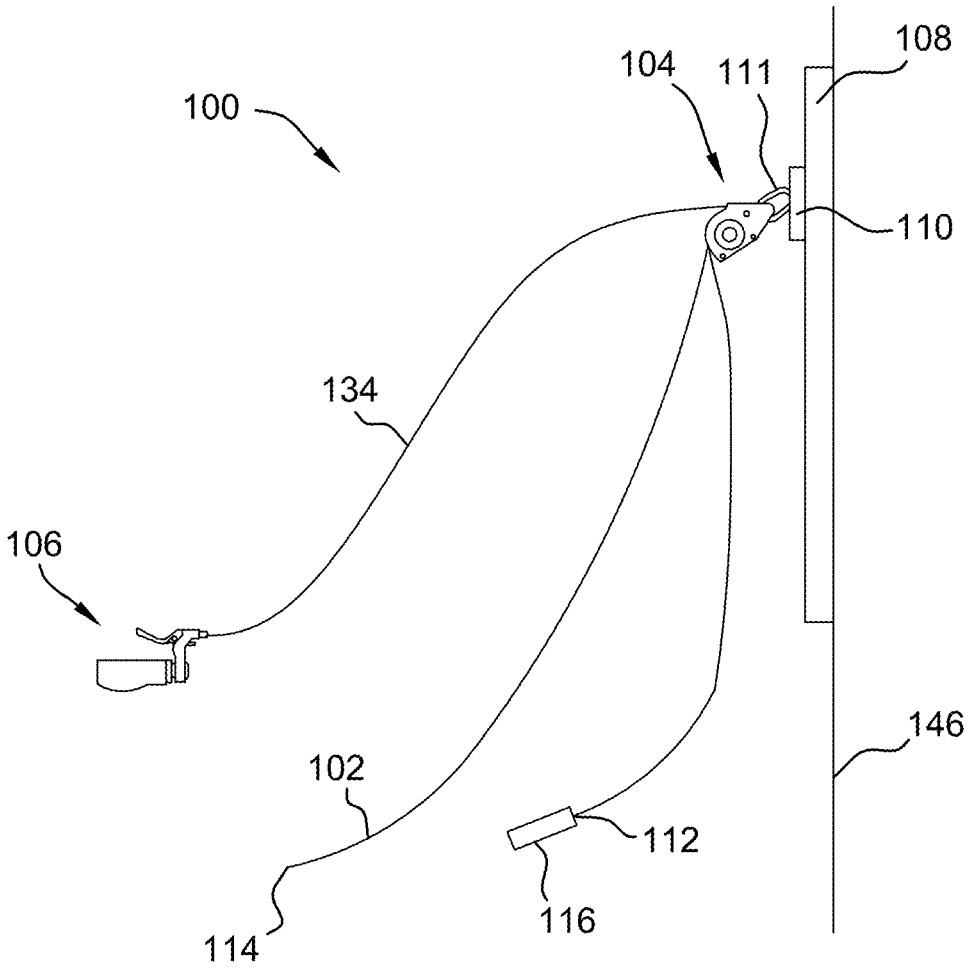
FIG. 1 is a schematic side view of a stretching apparatus including a ratchet device.

Referring now to the drawings and in particular to FIG. 1, one embodiment of a stretching apparatus is designated in its entirety by the reference number 100. The stretching apparatus 100 includes a strap 102, a ratchet device 104, a remote trigger 106, a track 108, and a mount 110. In other embodiments, the stretching apparatus 100 may include any suitable components that enable the stretching apparatus 100 to function as described herein.

The strap 102 includes a first end 112 and a second end 114. The first end 112 may attach to a user. In particular, in the illustrated embodiment, the first end 112 includes a band 116 that extends about a limb of the user to attach the strap 102 to the user. For example, the band 116 may attach to a leg, foot, ankle, wrist, arm, or any other suitable body part. The band 116 may be removably connected to the strap 102 by a clip, hook, or other suitable mechanism. In some embodiments, the strap 102 may wrap around a body part. In alternative embodiments, the stretching apparatus 100 may include any strap that enables the stretching apparatus to operate as described herein.

During operation of the stretching apparatus 100, tension is applied to the strap 102 to provide a stretch to the limb. Throughout the stretching exercise, the user may increase the tension in the strap 102 to increase the stretch. Accordingly, the stretching apparatus 100 allows the user to obtain a fuller stretch. The strap 102 may include indicators or markings to help the user determine the extent of the stretch and to record progress in stretching.

Figure 2:
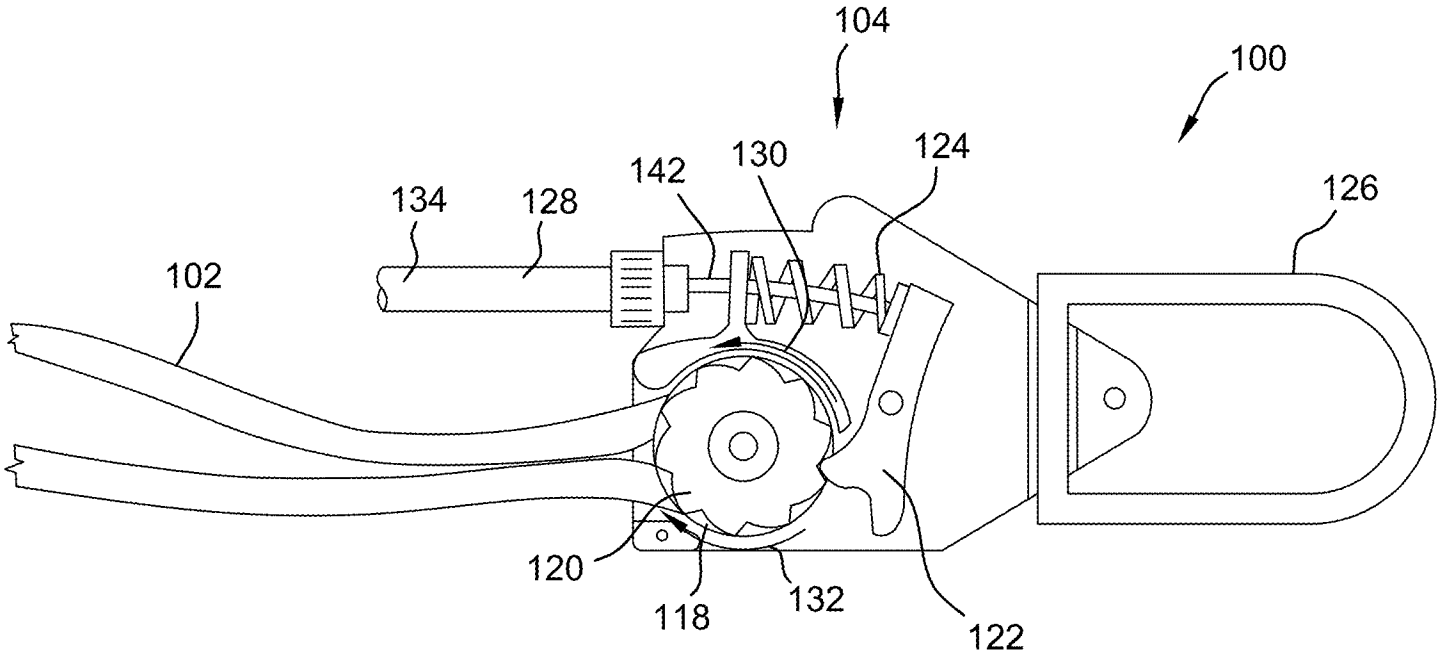
FIG. 2 is sectional side view of the ratchet device of the stretching apparatus shown in FIG. 1.

As shown in FIG. 2, the strap 102 extends through the ratchet device 104 such that the ratchet device controls tension in the strap. The ratchet device 104 includes a spool 118, a stepped disc 120, a ratchet lever 122, a biasing device 124, a connector 126, and a casing 128. The spool 118 receives the strap 102 and is rotatable to control movement of the strap through the ratchet device 104. The stepped disc 120 is connected to the spool 118 and rotates with the spool. The ratchet lever 122 is movable and selectively engages with the stepped disc 120. In particular, the ratchet device 104 is positionable between a ratcheting position where the ratchet lever 122 is engaged with the stepped disc 120 and a release position where the lever and stepped disc are not engaged. The biasing device 124 biases the ratchet lever 122 towards the ratcheting position. In alternative embodiments, the ratchet device 104 may have any position that enables the stretching apparatus 100 to operate as described herein.

In suitable embodiments, the ratchet device 104 may be any size that enables the stretching apparatus 100 to operate as described herein. For example, in the illustrated embodiment, the ratchet device 104 has a width of approximately 6 centimeters (cm) (2.5 inches (in.)) and a length of approximately 10 cm. (4 in.).

In the illustrated embodiment, the ratchet lever 122 engages the stepped disc to prevent movement of the stepped disc 120 in a counter-clockwise direction 130 when the ratchet device 104 is in the ratcheting position. The stepped disc 120 is allowed to move in a clockwise direction 132 when the ratchet device 104 is in the ratcheting position. When the ratchet device 104 is in the release position, the stepped disc 120 is allowed to move in the counter-clockwise direction 130 and the clockwise direction 132. In alternative embodiments, the ratchet device 104 controls movement of the strap in any directions that enable the stretching apparatus 100 to operate as described herein.

Figure 3:
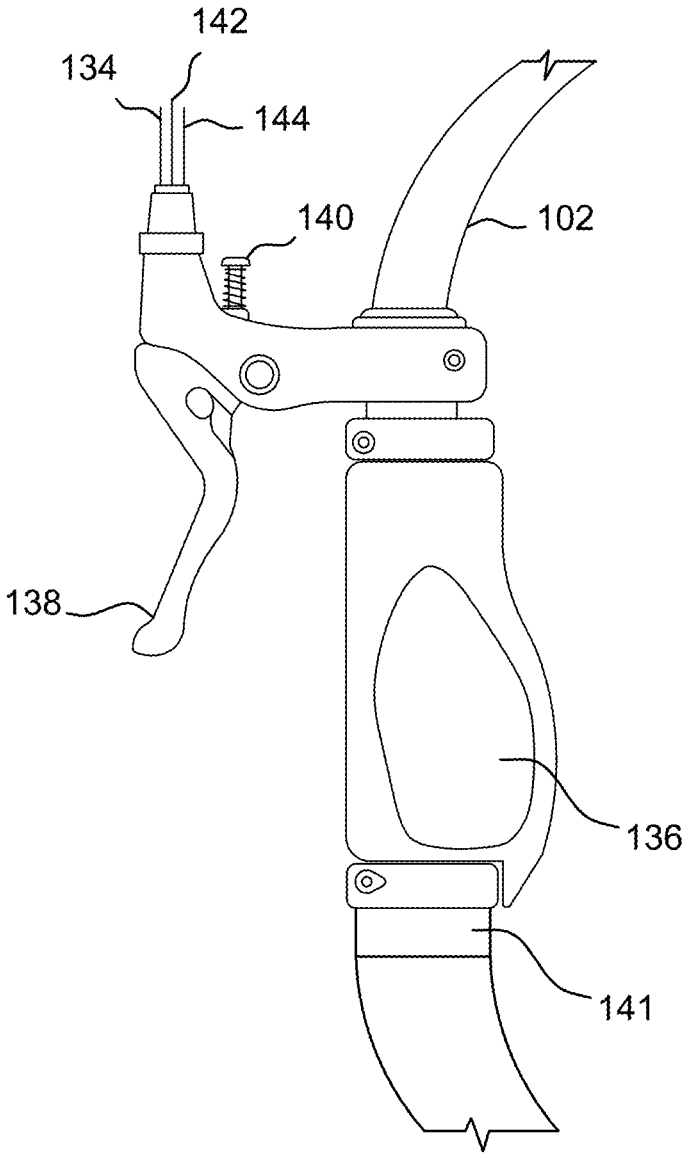
FIG. 3 is a side view of a remote trigger of the stretching apparatus shown in FIG. 1.

In reference to FIG. 3, the remote trigger 106 is connected to the ratchet device 104 (shown in FIG. 1) by a flexible line 134 and may be held by an individual during the stretching exercise at a distance from the ratchet device. For example, the flexible line 134 may have a length in a range of about 30 centimeters (cm) (1 foot (ft.)) to about 305 cm (10 ft.) or in a range of about 61 cm (2 ft.) to about 183 cm (6 ft.). In the illustrated embodiment, the flexible line 134 is approximately 102 cm. (40 inches (in.)). The remote trigger 106 may have a length in a range of about 5 cm (2 in.) to about 20 cm (8 in.). In alternative embodiments, the remote trigger 106 may be connected to the ratchet device 104 in any manner that enables the remote trigger 106 to operate as described. For example, in some embodiments, the remote trigger may communicate wirelessly with the ratchet device 104.

The remote trigger 106 includes a handle 136, a trigger lever 138, an adjustor 140, and a lock 141. The line 134 includes a tension wire 142 and a casing 144. In reference to FIGS. 2 and 3, the tension wire 142 is connected to the trigger lever 138 and the ratchet lever 122. When a force is applied to the trigger lever 138, the tension wire 142 is displaced and causes the ratchet lever 122 to move toward the release position. If the force is greater than the biasing force of the biasing device 124, the ratchet lever 122 will disengage the stepped disc 120 and allow free rotation of the spool 118. When the force on the trigger lever 138 is removed, the biasing device 124 may return the ratchet lever 122 to the ratcheting position. The adjustor 140 allows adjustment of the force required to displace the tension wire 142. The lock 141 secures the strap 102 in position relative to remote trigger 106. In other embodiments, the ratchet device 106 may be moved between the ratcheting position and the release position in any manner that enables the ratchet device to function as described herein. For example, in some embodiments, the biasing device 124 may be omitted and the ratchet device may not automatically return to the ratcheting position when the trigger force is removed.

Referring to FIG. 1, the strap 102 is arranged to extend through the ratchet device 104 such that the first end 112 may be pulled closer to the ratchet device by pulling on the second end 114. During a stretching exercise, the user may attach the strap 102 to a limb and extend the limb in a stretching position. To provide a stretching force to the limb, the user may pull on the second end 114 to pull the strap 102 through the ratchet device 104 and increase the tension on the strap 102. Accordingly, the stretching apparatus 100 allows a user to fully extend the limb and maintain the extension. When the user wishes to release tension in the strap 102 and relax the stretch, the user may actuate the remote trigger 106 and move the ratchet device 104 to the released position. The released position allows the first end 112 to move away from the ratchet device 104 and lessens the force on the user's limb. The user may remove the body part from the band 116 and attach the band 116 to a different body part for a different stretch. Also, the user may reposition the mount 110 for a different stretch.

In the illustrated embodiment, the track 108 is connected to a wall 146 to support the stretching apparatus 100. The track 108 may be positioned in vertical, horizontal, or angled positions. The track 108 may be connected to the wall 146 by fasteners or other suitable securement devices. The track 108 may be removed from the wall 146 and positioned on other support structures. As a result, the stretching apparatus 100 is at least partially portable and may be stored when not in use. In addition, the stretching apparatus 100 is suitable for use in living areas with limited space and does not require dedicated exercise space. In some embodiments, the stretching apparatus 100 may be connected to other exercise equipment such as rack assemblies.

The mount 110 is connected to the ratchet device 104 and supports the ratchet device during a stretching exercise. In particular, a connector 111 removably connects the ratchet device 104 to the mount 110. In alternative embodiments, the ratchet device 104 may be connected to the mount 110 in any manner that enables the stretching apparatus 100 to operate as described herein. In some embodiments, the mount 110 may be permanently affixed to or integral with the ratchet device 104.

The ratchet device 104 and the mount 110 are adjustably connected to the track 108 to allow the stretching apparatus 100 to be used for a variety of stretching exercises. Accordingly, the ratchet device 104 and the mount 110 may be positioned in different positions and allow the stretching apparatus 100 to be used for a range of stretching exercises by different users. In alternative embodiments, the track 108 and mount 110 may have any positions that enable the stretching apparatus 100 to operate as described herein.

Figure 4:
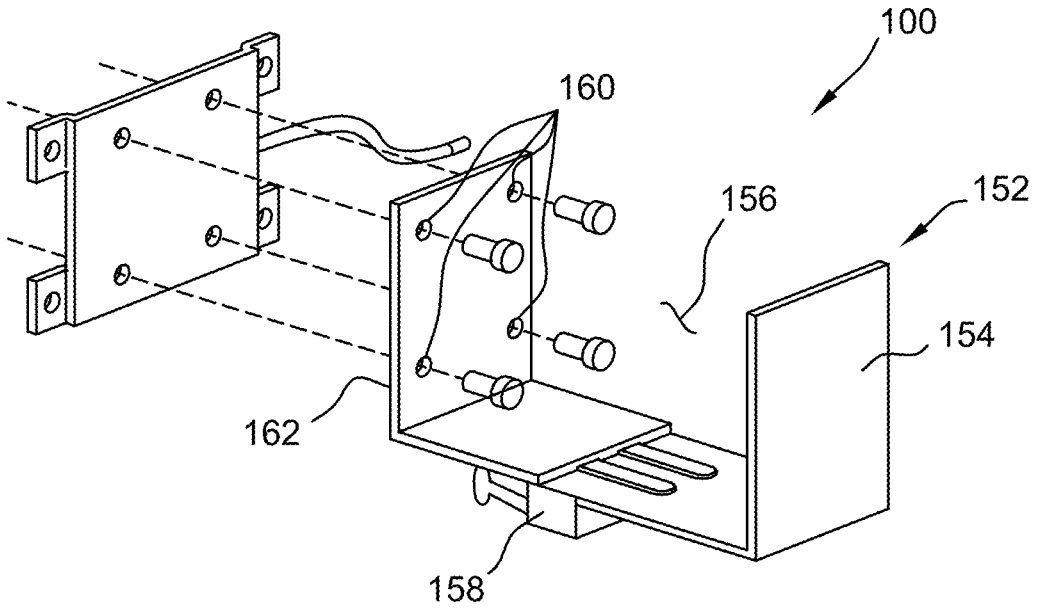
FIG. 4 is a schematic view of a clamp connecting to a mount of the stretching apparatus shown in FIG. 1.
Figure 7:
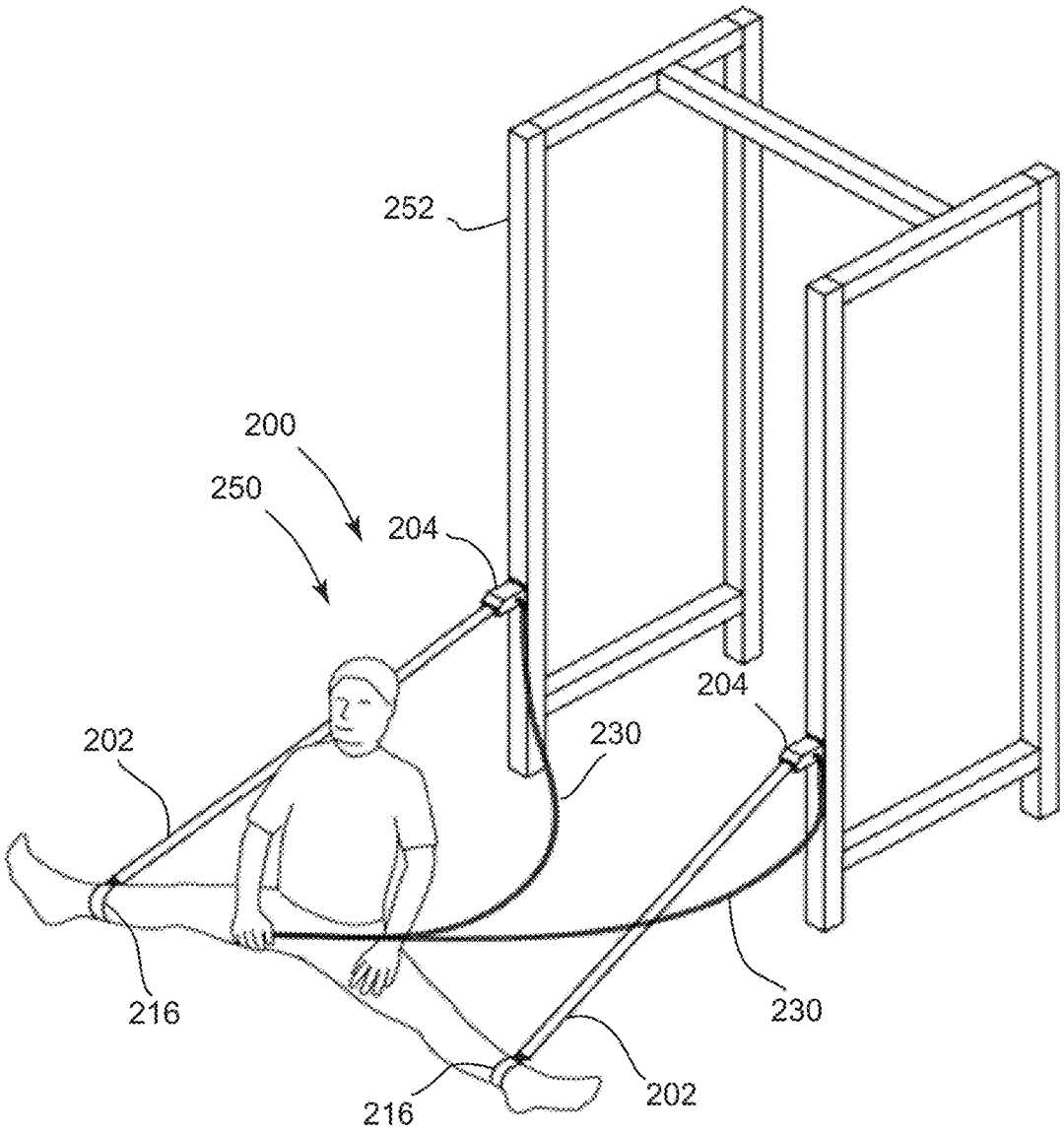

In reference to FIG. 4, the stretching apparatus 100 may include a clamp 152 to attach the mount 110 to a support structure such as a rack assembly 252 (shown in FIG. 7). The clamp 152 includes a body 154 defining a cavity 156 to receive an object such as a bar of the rack assembly 252. A tightener 158 is used to adjust the cavity 156 and secure the clamp 152 on the support structure. Suitably, the clamp 152 is tightened until the clamp 152 does not move relative to the support structure. The clamp 152 may include pads to prevent damage to the support structure. The mount 110 is connected to the clamp 152 using openings 160 in a leg 162 of the clamp 152.

In alternative embodiments, the mount 110 may be connected to the support structure in any manner that enables the stretching apparatus 100 to operate as described herein.

For example, in some embodiments, the mount 110 may be secured using fasteners, adhesives, cords, clips, hooks, and any other suitable securement devices. In further embodiments, the stretching apparatus 100 may be connected to any suitable support structure. For example, in some embodiments, the stretching apparatus 100 may be connected to boards. In some embodiments, the ratchet device 104 may directly connected to the support structure.

Figure 5:
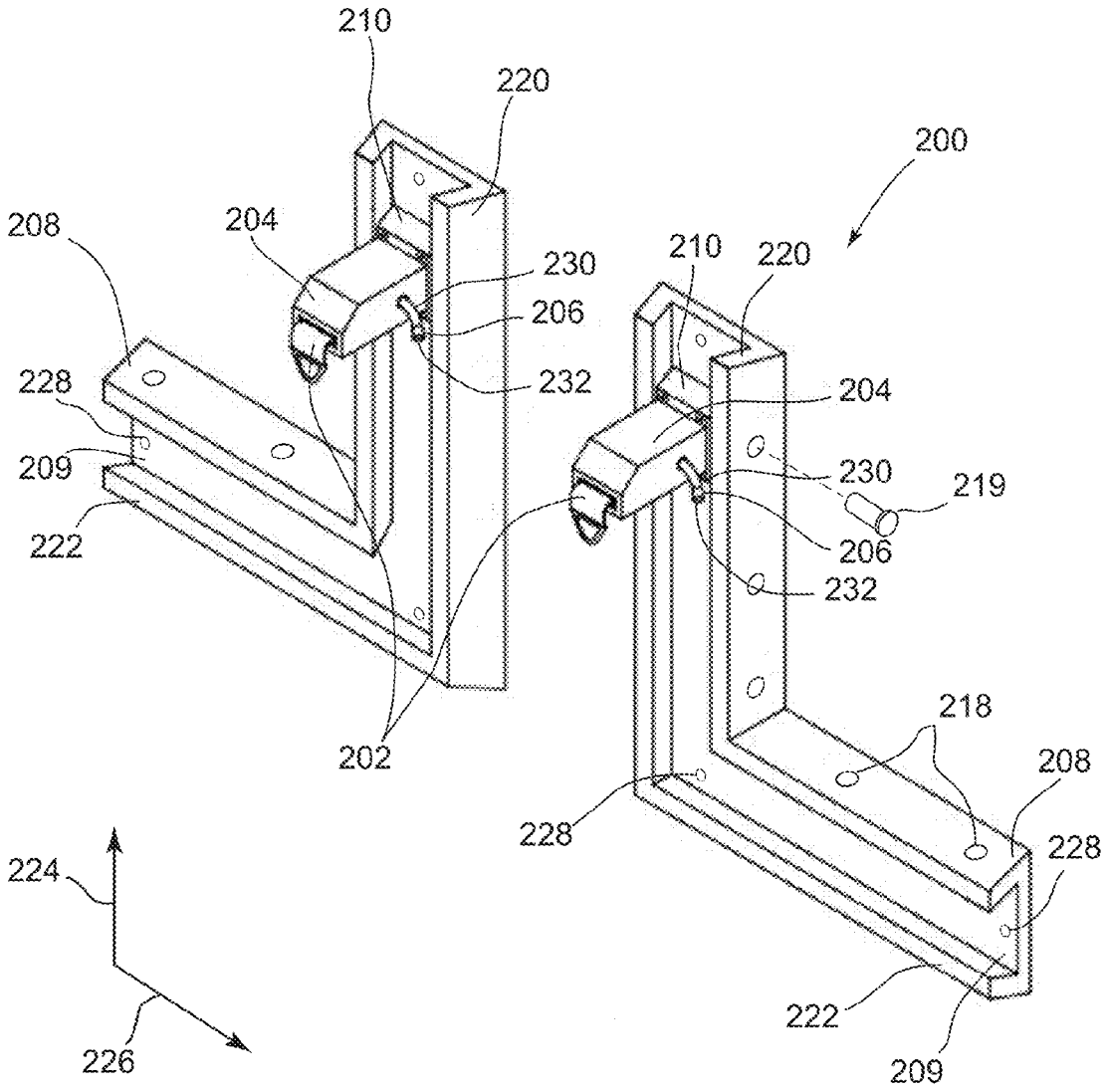
FIG. 5 is a perspective view of an alternative embodiment of a stretching apparatus.

Referring now to FIG. 5, another embodiment of a stretching apparatus is designated in its entirety by the reference number 200. The stretching apparatus 200 includes straps 202, ratchet devices 204, remote triggers 206, tracks 208, and mounts 210. Each strap 202 may connect to a band 216 (shown in FIG. 6) that extends about a limb of a user 250 (shown in FIG. 6) to attach the strap 202 to the individual.

Each track 208 includes a u-shaped rail defining a channel 209 to receive a portion of the mounts 210. The mounts 210 are slidable along the tracks 208 to adjust the position of the stretching apparatus 200. In particular, the mounts 210 and the channel 209 have corresponding trapezoidal shapes. The mounts 210 are slightly smaller than the channel 209 to provide a sliding fit. In alternative embodiments, the stretching apparatus 200 may include any mounts 210 that enable the stretching apparatus 200 to operate as described herein. For example, in some suitable embodiments, the mounts 210 are slightly larger than the channel 209 and slide over the channel 209.

In addition, in the illustrated embodiment, each track 208 includes a vertical portion 220 and a horizontal portion 222. Accordingly, the mounts 210 may be moved along the tracks 208 in a vertical direction 224 and a horizontal direction 226. Directions indicated herein refer to the orientation of apparatus 200 shown in FIG. 5. In the illustrated embodiment, the tracks 208 are positioned such that the vertical portions 220 are aligned and the horizontal portions 222 are aligned. The vertical portions 220 have a length in a range of about 30 millimeters (mm) (12 inches (in.)) to about 152 mm (60 in.). The horizontal portions 222 have a length in a range of about 30 mm (12 in.) to about 152 mm (60 in.). In the illustrated embodiment, each the vertical portions 220 and the horizontal portions 222 are each about 91 mm (36 in. In alternative embodiments, the stretching apparatus 200 may have any track that enables the stretching apparatus 200 to operate as described herein.

The tracks 208 may be attached to a wall to provide support to the stretching apparatus 200. The tracks 208 include a plurality of openings 228 to receive fasteners for attaching the tracks 208 to the wall. In addition, each track 208 includes a plurality of openings 218 spaced along the track to define a plurality of positions for the mount 110. The openings 218 are in the sides of the tracks 208 and are arranged to receive a positioning pin 219 for connecting the mounts 210 to the tracks 208. Accordingly, the tracks 208 allow the stretching apparatus 200 to be used for different stretching exercises.

In this embodiment, the remote triggers 206 are connected to the ratchet devices 204 by a flexible line 230. The remote triggers 206 include buttons 232 that a user may actuate to move the ratchet devices 204 between a ratcheting position and a release position. In the ratcheting position, the user may pull on the remote triggers 206 to increase tension in the strap 202. In the release position, the flexible lines 230 may be retracted into the ratchet devices 204 and the tension in the strap 202 may be lessened. Accordingly, the remote triggers 206 allow the user to control tension in the strap 202 during a stretching exercise.

Figure 6:
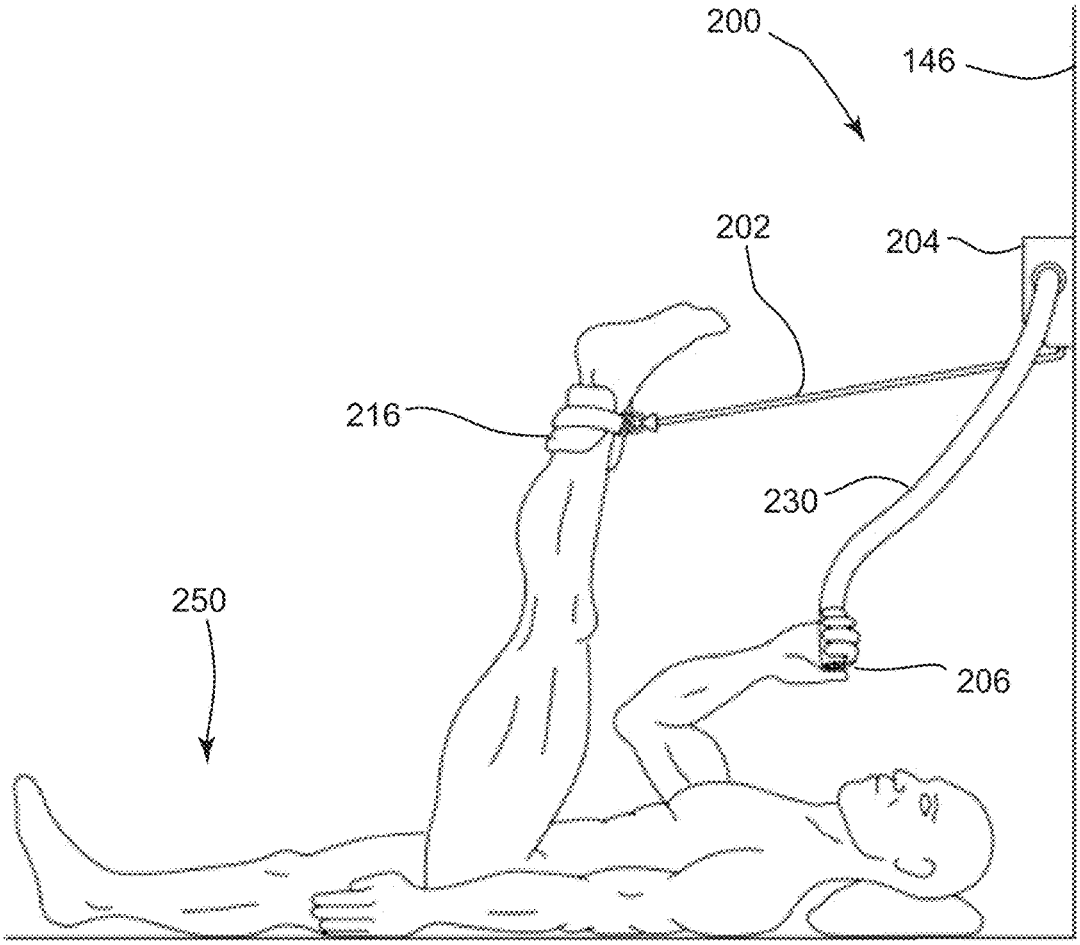
FIGS. 6-8 are schematic illustrations of individuals using the stretching apparatus shown in FIG. 5.
Figure 8:
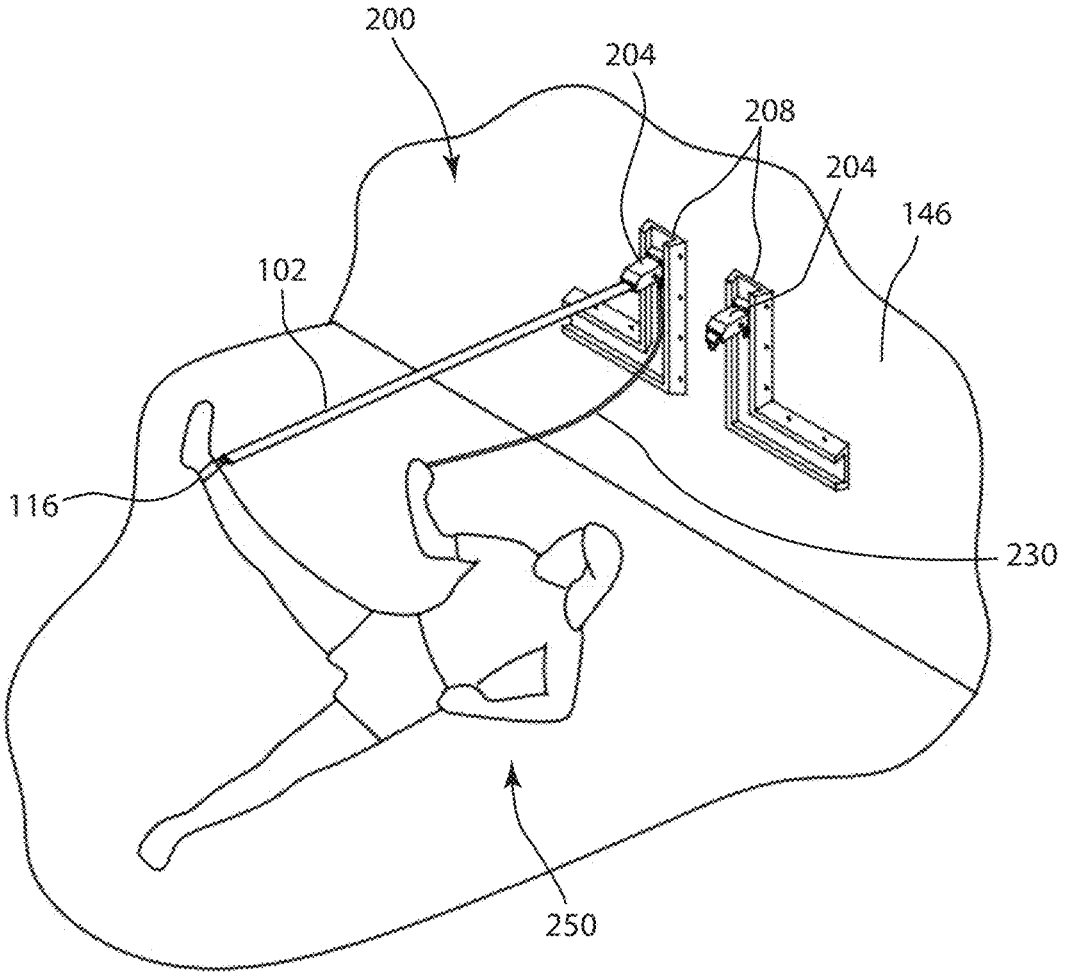

FIGS. 6-8 show the stretching apparatus 200 being used for stretching exercises. As shown in FIG. 6, the straps 202 may be attached to a limb while a user 250 extends the limb. For example, the user 250 may lie on the ground a distance from the wall 146 and extend the leg with the strap 202 attached to an ankle. The user 250 may actuate the remote trigger 206 to draw the strap 202 through the ratchet device 204 and increase the stretching force on the leg. When the stretching exercise is complete, the user 250 may actuate the remote trigger 206 to release tension on the strap 202. In the illustrated embodiment, the stretching apparatus 200 is attached to the wall 146 and positioned above the leg of the user 250.

Referring to FIG. 7, the straps 202 may be attached to different body parts during a stretching exercise. For example, in the illustrated embodiment, each strap 202 is attached to an ankle of the user. During the stretching exercise, the user is facing away from the stretching apparatus 200 with both legs extended in opposite directions. The ratchet devices 204 are connected to a rack assembly 252 in a desired position during the stretching exercise. In the illustrated embodiment, the ratchet devices 204 are positioned above the ankles and below the head of the user 250.

In reference to FIG. 8, the tracks 208 may be mounted to the wall 146 and the ratchet devices 204 positioned in the tracks 208. In particular, the mounts 210 are positioned in the vertical portions 220 such that the ratchet devices 204 are positioned at the greatest distance from the floor and are separated horizontally by the space between the tracks 208. While only one strap 202 is attached to the user in the illustrated embodiment, it is understood that both straps 202 may be attached to the user during stretching exercises.

The stretching apparatus described herein are simpler to assemble and use than known apparatus. For example, embodiments of the stretching apparatus may be adjusted to different positions and used for different stretching exercises. The stretching apparatus includes a ratchet device that increases tension in a band attached to the individual's limb to provide a full stretch. A remote trigger allows the individual to release tension on the strap without moving out of a stretching position. In addition, a mount allows the stretching apparatus to be connected to different support structures such as walls and exercise equipment.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description and shown in the accompanying drawings shall be interpreted as illustrative and not in a limiting sense. Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A stretching apparatus for use during a stretching exercise, the stretching apparatus comprising:

a strap configured to attach to a limb of a user;

a ratchet device for controlling tension in the strap, the strap extending through the ratchet device, the ratchet device being positionable between a ratcheting position and a release position, wherein the ratcheting position prevents movement of the strap in a first direction and allows movement of the strap in a second direction, and wherein the release position allows movement of the strap in the first direction;

a remote trigger connected to the ratchet device to move the ratchet device between the ratcheting position and the release position; and a flexible line connecting the remote trigger to the ratchet device, wherein the remote trigger is configured to be held by the user during the stretching exercise.

2. The stretching apparatus of claim 1, wherein the strap includes a first end and a second end, the first end being configured to attach to the limb of the user, the second end being configured to be grasped by the user, wherein the strap is arranged to extend through the ratchet device such that the first end is pulled closer to the ratchet device by pulling on the second end.

3. The stretching apparatus of claim 1, wherein the flexible line comprises a tension wire that is displaced to move the ratchet device between the ratcheting position and the release position.

4. The stretching apparatus of claim 3, wherein the ratchet device includes a biasing device to bias the ratchet device towards the ratcheting position.

5. The stretching apparatus of claim 3, wherein the remote trigger includes a lever connected to the flexible line and arranged to displace the tension wire.

6. The stretching apparatus of claim 1 further comprising a mount arranged to connect to the ratchet device and support the ratchet device during the stretching exercise.

7. The stretching apparatus of claim 6 further comprising a clamp configured to attach to the mount, wherein the clamp is configured to secure the ratchet device to a bar such that the bar supports the ratchet device during the stretching exercise.

8. The stretching apparatus of claim 6 further comprising a track arranged to receive the mount, the mount being slidable along the track to adjust the position of the ratchet device relative to the track such that the ratchet device is positionable in a first position and a second position, wherein the first position allows the stretching apparatus to be used for a first stretching exercise and the second position allows the stretching apparatus to be used for a second stretching exercise.

9. The stretching apparatus of claim 8, wherein the track includes a vertical portion and a horizontal portion such that the mount may be moved in a vertical direction and a horizontal direction.

10. The stretching apparatus of claim 9, wherein the track includes a u-shaped rail defining a channel.

11. The stretching apparatus of claim 10, wherein the rail defines a plurality of openings spaced along the track for securing the ratchet device in different positions.

12. A stretching apparatus for use during a stretching exercise, the stretching apparatus comprising:

an elastic strap configured to attach to a limb of a user;

a ratchet device for controlling tension in the strap, the strap extending through the ratchet device;

a mount arranged to connect to the ratchet device and support the ratchet device during the stretching exercise;

a track arranged to receive the mount and connect to a surface to support the ratchet device during the stretching exercise, the mount being slidable along the track to adjust the position of the ratchet device relative to the track such that the ratchet device is positionable in a first position and a second position, wherein the track includes a u-shaped rail defining a channel; and a clamp, wherein the clamp is configured to mount the ratchet device to a structure such that the structure supports the ratchet device during the stretching exercise.

13. The stretching apparatus of claim 12, wherein the rail defines a plurality of openings spaced along the track for securing the ratchet device in different positions.

14. The stretching apparatus of claim 12, wherein the track includes a vertical portion and a horizontal portion such that the mount may be moved in a vertical direction and a horizontal direction.

15. The stretching apparatus of claim 12 further comprising:

a second strap configured to attach to a second limb of the user;

a second ratchet device for controlling tension in the second strap, the strap extending through the ratchet device;

a second mount arranged to connect to the ratchet device and support the ratchet device during the stretching exercise; and a second track arranged to receive the mount, the mount being slidable along the track to adjust the position of the ratchet device relative to the track such that the ratchet device is positionable in a first position and a second position.

16. The stretching apparatus of claim 15, wherein each of the first track and the second track includes a vertical portion and a horizontal portion, the first track and the second track arranged to mount to the wall such that the horizontal portions are aligned.

17. A method of assembling a stretching apparatus for use during a stretching exercise, the method comprising:

connecting a ratchet device to a mount, wherein a strap extends through the ratchet device such that the ratchet device controls tension in the strap, the strap including a first end and a second end, the first end configured to attach to a limb of a user, the second end configured to be grasped by the user;

connecting a track to a wall, wherein the track is arranged to receive the mount;

movably connecting the mount to the track, the mount being slidable along the track to adjust the position of the ratchet device relative to the track such that the ratchet device is positionable in a first position and a second position;

moving the mount to the first position; and securing the mount in the first position.

18. The method of claim 17 further comprising moving the mount to the second position and securing the mount in the second position.

* * * * *